United States Patent [19]

MacRae et al.

[11] 4,234,334

[45] Nov. 18, 1980

[54] ARC CONTROL IN PLASMA ARC REACTORS

[75] Inventors: Donald R. MacRae, Bethlehem; Richard G. Gold, Coopersburg, both of Pa.

[73] Assignee: Bethlehem Steel Corporation, Bethlehem, Pa.

[21] Appl. No.: 2,288

[22] Filed: Jan. 10, 1979

[51] Int. Cl.[3] ..... C22B 5/52; C22B 4/00

[52] U.S. Cl. ..... 75/10 R; 75/11; 75/65 EB

[58] Field of Search ..... 75/10-12, 75/65 EB

[56] References Cited

U.S. PATENT DOCUMENTS

| | | | |
|---|---|---|---|
| Re. 28,570 | 10/1975 | Tylko | 13/9 |
| 3,020,151 | 2/1962 | Nachtman | 75/82 |
| 3,239,572 | 3/1966 | Snow | 75/10 R |
| 3,429,691 | 2/1969 | McLaughlin | 75/10 R |
| 3,432,606 | 3/1969 | Kociscin | 75/10 R |
| 3,505,460 | 4/1970 | Bruning | 75/10 R |
| 3,524,006 | 8/1970 | Ebeling | 75/10 R |
| 3,852,061 | 12/1974 | Wulft | 75/10 R |
| 4,002,466 | 1/1977 | MacRae | 75/11 |

OTHER PUBLICATIONS

S. M. L. Hamblyn, "Plasma Technology and Its Application to Extractive Metallurgy," Minerals Science Engineering, vol. 9, No. 3, (Jul., 1977).

P. A. Huska et al., "Decomposition of Molybdenum Disulfide in an Induction-Coupled Argon Plasma," I & EC Process Design & Development, vol. 6, No. 2, (1967).

J. A. Charles et al., "Processing of Minerals in an Induction-Coupled Plasma Torch," Transactions of the Institution of Mining & Metallurgy, Section C79, (1970).

R. J. Munz et al., "The Decomposition Kinetics of Molybdenite in an Argon Plasma," A.I.Ch.E. Journal, vol. 21, No. 6, (1975).

*Primary Examiner*—P. D. Rosenberg

*Attorney, Agent, or Firm*—Joseph J. O'Keefe; C. A. Wilkinson; M. Leach

[57] ABSTRACT

A process for controlling the arc in plasma arc reactors having two electrodes in which reactor the reaction charge forms a reaction layer covering one of the electrodes and is a point of arc attachment. The reaction layer is characterized as non-conductive for a period of time causing an arc struck between the uncovered electrode and the reaction layer to short-circuit. An electrically conductive material is added to the reaction layer stabilizing the arc. Substantially pure molybdenum is prepared from molybdenum disulfide.

14 Claims, 2 Drawing Figures

ARC CONTROL IN PLASMA ARC REACTORS

FIELD OF THE INVENTION

This invention relates to plasma arc reactors and, more particularly, to a process for controlling the arc in a plasma arc reactor.

BACKGROUND OF THE INVENTION

Many devices and procedures have been developed for reacting or treating ores and other metallic compounds in plasma reactors in which the plasma may be generated by radio-frequency induction or by striking an arc between two electrodes. In both types of plasma reactors the ore or any other materials composing the reactant charge or feed are reacted or treated by entraining them in the plasma gas within the reactor for as long as possible in order to expose the materials to the intense heat for a sufficient period of time. Since the reacting materials are in a suspended state, a substantial residence time in the plasma reactor's extremely hot environment is required to ensure that the reacting materials contact each other so that the desired reaction will occur to a reasonable degree. Besides the difficulty with attaining adequate residence times, the plasma arc reactors may exhibit anode erosion caused by the severe conditions existing at the point of attachment of the electric arc to the anode. With the reactants suspended in the plasma between the electrodes, the arc directly impinges upon the anode eroding it.

A method and apparatus are described in U.S. Pat. No. 4,002,466 for obviating the problem of anode erosion and for providing the reactants with an extended residence time and intimate contact within the plasma reactor. A plasma arc torch is disclosed which incorporates a swirling vortical stabilizing gas stream within a reaction chamber formed by an anode tube. Reactant particles introduced between the ends of the anode are entrained in the vortex. When an arc is struck to generate the plasma, sufficient heat is afforded to melt the particles into a falling-film of material on the wall of the anode.

In the device of the patent the electric arc no longer directly impinges the anode wall but rather attaches via the film of material coating the anode wall. The falling film thus acts as a protective as well as a thermally insulating coating on the anode tube. Furthermore, the vortically swirling gas stream stabilizes the location of the arc attachment to the falling-film.

However, a serious problem arises during the reaction of certain compounds in such falling-film plasma arc reactors and other transferred plasma arc reactors.

By transferred plasma arc reactor we mean a plasma arc reactor in which the electrical arc stabilizes between an electrode (cathode) and the workpiece which is connected in a circuit as the other electrode (anode). A transferred plasma arc can be created in two ways. First, a pilot plasma arc can be struck between a cathode and an anode in a plasma reactor which has the working (stabilizing) gas fed under a high velocity between the electrodes to exit out an opening. Situated in close proximity to this opening is a workpiece that is connected into the electrical circuitry such that it too is an anode. The flow rate of the working gas through the plasma reactor is increased to the point where the electrical arc is actually blown down from the reactor anode to attach to the workpiece anode. The electrical arc and the plasma stream now extend from the cathode within the reactor to the workpiece.

A common embodiment of this type of transferred plasma arc furnace comprises an electrode positioned in the bottom of a crucible or containing vessel which holds a layer of melt or solid scrap to be melted by the plasma. The plasma arc torch is disposed apart from the containing vessel. In this embodiment, which is shown as FIG. 1 and is described in a subsequent part of this specification, the electrical arc is blown down to transfer and attach to a workpiece anode via the melt or solid scrap in the vessel.

Therefore, we define a transferred plasma arc reactor as being a plasma arc reactor in which the electrical arc emanating from one electrode attaches to a reaction layer covering a second electrode. The reaction layer may comprise the charged reactants solely or also include reaction products.

The second method of creating a transferred plasma arc is one in which the electrical arc is caused to attach to the film on the anode tube in a falling film reactor. It is obvious that such a falling film plasma arc reactor comes within the definition of a transferred plasma arc reactor set forth above.

The problem associated with such transferred arc reactors, as defined above, can be explained by way of the following example. The decomposition reaction of molybdenum disulfide ($MoS_2$) to produce metallic molybdenum was attempted utilizing a falling-film plasma reactor. The molybdenum disulfide was fed to the reactor as is known in the art but the reaction did not proceed. Almost no product was formed and the throat section of the anode above the ore injection ports and falling film was badly eroded. This erosion was apparently caused by a wandering electrical arc.

Accordingly, there is a need for a method of controlling the arc in a transferred plasma arc reactor.

There is a need for a method of preventing the erosion of the anode of a falling film, transferred plasma arc reactor caused by a wandering electrical arc.

There is a further need for a method of producing molybdenum from molybdenum disulfide in a plasma arc reactor.

SUMMARY OF THE INVENTION

We have discovered a process for controlling the electrical arc in a transferred plasma arc reactor which, in addition, readily affords the production of molybdenum from molybdenum disulfide. The attempted decomposition reaction of molybdenum disulfide in the falling film plasma arc reactor resulted in the destruction of the throat section of the anode. We theorize that there is a short circuiting of the electrical arc because of the coating of melted molybdenum disulfide on the anode wall, molybdenum disulfide being a non-conductive material. Hence, the arc is forced to strike to the anode in the throat section above the level of the ore feed ports which establishes the upper boundary of the non-conductive falling film.

We believe the attachment of the arc to the anode is defined, among other factors, by the composition of the falling film. If the initial reactant charge, intermediate material, the reaction products or any mixture of these renders the falling film or a portion of it non-conductive, the attachment of the arc will be displaced causing erosion problems at the exposed areas of the anode. It is readily apparent that this analysis of the problem of the wandering arc in a falling film plasma arc reactor is applicable to any plasma arc reactor having an electrode covered by such a reaction layer or film.

Our process permits arc control in plasma arc reactors having a first and a second electrode in which a reaction layer covers the first electrode and is a point of arc attachment. When the reaction layer, comprising the reactants, intermediate material or final products or any mixture of these, is non-conductive at some point during the reaction causing an arc struck between the electrodes via the reaction layer to short circuit, the addition of an electrically conductive material to the reaction layer renders the reaction layer conductive and stabilizes the attachment of the arc between the uncovered second electrode and the reaction layer-covered first electrode. If a falling-film is non-conductive at some point during its descent causing short circuiting of the electrical arc, an electrically conductive material is added to the falling film rendering the film conductive to stabilize the arc. The electrically conductive material may be added directly to the reaction layer or falling film, or it may be added as part of the reactant charge or feed.

The invention is particularly applicable to a process for decomposing a non-conductive metallic compound to recover the metal using a plasma arc reactor in which a feed of the non-conductive metallic compound forms a falling-film on a wall of the electrode, such as reacting molybdenum disulfide to produce molybdenum.

DETAILED DESCRIPTION OF THE INVENTION

Figure 1:
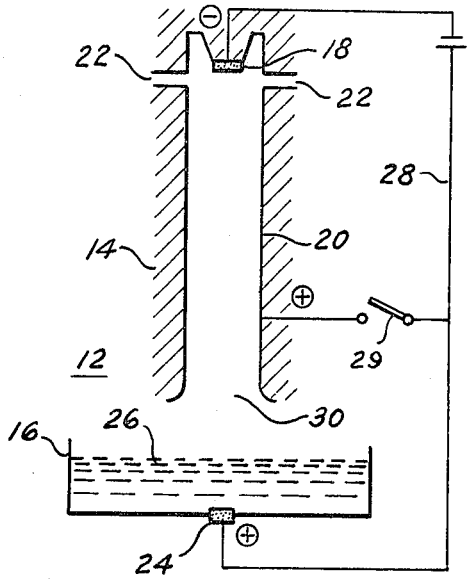
FIG. 1 is a schematic diagram of a transferred plasma arc furnace in which the electrical arc is blown down to the workpiece electrode.

FIG. 1 schematically shows a transferred plasma arc furnace 12 for the bulk treatment of material. The furnace comprises a plasma arc torch 14 and a receiving vessel or crucible 16. The torch 14 has a cathode section 18 insulated from anode section 20 and gas inlet ports 22. In the bottom of vessel 16 is another anode 24 covered by the reaction layer 26 contained in the vessel. A plasma gas such as argon or hydrogen is injected at very high velocity into the torch 14 via ports 22 and out of opening 30. Utilizing electrical circuit 28 with switch 29 closed, a pilot arc is struck between cathode 18 and anode 20 generating a plasma within torch 14. The plasma gas exits torch opening 30 to heat reaction layer 26.

The flow rate of the gas stream entering through ports 22 can be increased to such a degree that the electrical arc is blown down and off the anode 20 so that it completes the circuit with anode 24 by attaching to reaction layer 26. When this occurs, switch 29 is opened.

When reaction bath 26 is non-conductive, the electrical arc will not attach to the surface of the reaction layer but will be forced to attach to the outside edge of anode 20, causing extensive erosion. Alternatively, the electrical arc will be simply blown out, or extinguished. By introducing an electrically conductive material to the reaction layer, the arc attachment and, consequently, the plasma stream may be stabilized upon the reaction layer. The electrically conductive material may be fine carbon, iron powder or any fine electrically conducting material that renders the transferred plasma arc reactor furnace operative when the final, intermediate or initial compositions of the reaction layer are electrically non-conductive.

Figure 2:
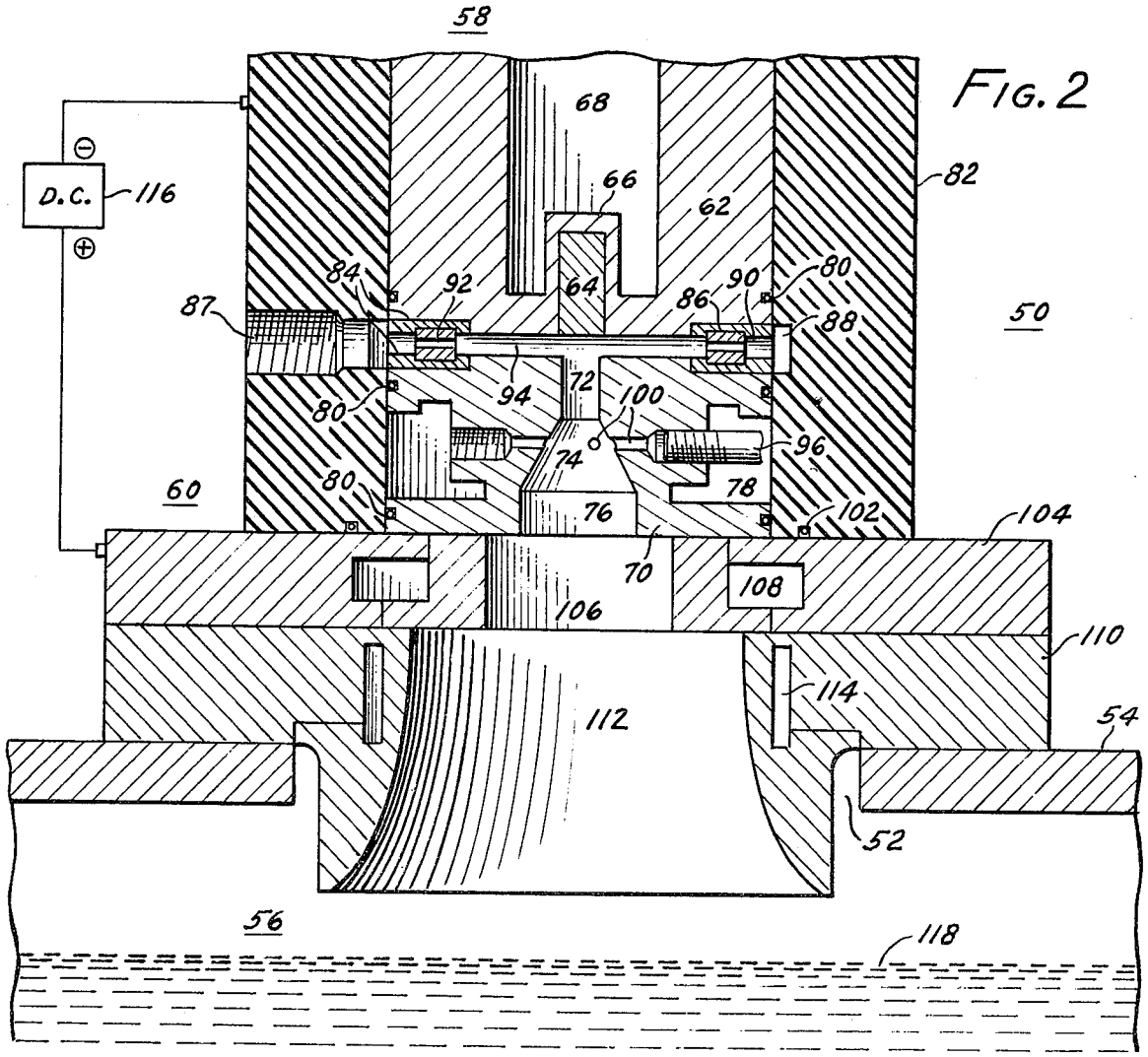
FIG. 2 is a vertical section through a short anode plasma arc reactor used in the practice of the invention.

FIG. 2 shows a vertical section through a typical falling film plasma arc furnace. As depicted in FIG. 2 a short anode, 100 kW falling film reactor 50 is securely positioned in annular opening 52 in the lid 54 of a refractory-lined crucible 56. The short anode reactor is basically like the plasma arc reactors disclosed in U.S. Pat. Nos. 4,002,466 and 4,099,958 to MacRae et al, which are incorporated by reference in this specification. The reactors of these patents have longer anode tubes.

The reactor 50 is annular in cross section and broadly comprises a cathode section 58 and a short anode section 60. The cathode section 58 comprises a copper cathode barrel 62 containing a thoriated tungsten button 64 which is mounted within a depression 66 in the bottom of the cathode barrel 62 and which affords a point of arc attachment. The upper end of cathode barrel 62 is sealed by a brass cover, not shown, having means to pass water through cavity 68 to cool cathode section 58.

Along the axis of ore anode 70 positioned below cathode barrel 62 is a cavity comprising three sections, namely a throat 72, a truncated conical ore feed chamber 74 and a cylindrical opening 76. Grooved into the periphery of ore anode 70 is annular water passage 78.

O-Rings 80 are positioned in circumferential grooves in the cathode barrel 62 and ore anode 70 which are in turn surrounded by nylon insulating collar 82.

Disposed between and electrically insulated from cathode barrel 62 and ore anode 70 by spacers 84 is gas ring 86. Stabilizing gas enters reactor 50 via inlet bores 87 through insulating collar 82 that communicate with passageway 88 concentrically aligned and connected with the space 90 between the cathode barrel 62 and ore anode 70. The stabilizing gas passes through gas ring 86 which is provided with a plurality of passages 92 that deliver the gas tangentially into opening 94 causing the gas to vortically swirl as it passes into throat 72.

Solid particles of ore are fed into the truncated conical ore feed chamber 74 of ore anode 70 and between the ends of the electrical arc via feed tubes 96 passing through bores, not shown, within insulating collar 82. Tubes 96 extend through annular water passage 78 and are threaded securely to ore feed passages 100 in ore anode 70. Passages 100 terminate tangentially into chamber 74 so that the solid particles of ore are concurrently injected into the swirling gaseous vortex to facilitate the formation of a falling film on the interior wall of ore anode 70 which defines chamber 74 and opening 76. Cooling water is introduced into and removed from annular water passage 78 via outlets and inlets, not shown, in insulating collar 82.

O-Ring 102 is positioned in a concentric groove in the bottom of insulating collar 82 which is fixed to a disc-shaped short anode flange 104. Aperture 106 in flange 104 is coaxial with and has a larger diameter than opening 76 of ore anode 70. Cooling water is conducted through annular passageway 108 in flange 104. Disposed adjacent to the underside of short anode flange 104 is annular reactor lid flange 110 having an opening 112 coaxial with aperture 106. Opening 112, the upper end of which is of larger diameter than aperture 106, flares outwardly at the bottom. Lid flange 110 also has radially disposed bores, not shown, for conducting cooling water through annular passageway 114. The cathode barrel 62 and the anode flange 104 are connected to the negative and positive sides, respectively, of a conventional power supply 116 which is preferably a d.c. 200 volt, 1000 ampere supply.

In operation cooling water is supplied to cathode barrel 62, ore anode 70, short anode flange 104 and reactor lid flange 110 through their associated inlets, bores, passageways and tubing, some of which are not shown. Pressurized stabilizing gas enters reactor 50 under pressure through bores 87 and diffuses throughout passageway 88 and space 90. The gas proceeds through passages 92 in gas ring 86 at high velocity tangentially into opening 94 where it circulates adjacent the cathode button 64 in a swirling vortical manner and travels downwardly in a swirling motion along the inner walls of the anode section 60 defining throat 72, chamber 74, opening 76, aperture 106 and opening 112. This movement of the gas stabilizes an electrical arc established between the tungsten button 64 of cathode barrel 62 and the anode section 60 generating a plasma. More precisely, it is believed that the arc attaches to the inner wall of ore anode 70 defining cylindrical opening 76. To prevent corrosion of button 64, the stabilizing gas must be non-reactive with the thoriated tungsten and may be helium, argon, hydrogen, nitrogen or a mixture of these.

Pulverized ore or discrete particles of reactants are conveyed by a carrier gas via ore feed tubes 96 and passages 100 into the truncated conical ore feed chamber 74 between the ends of the electrical arc. The reactants may also be introduced with the stabilizing gas intermediate the ends of the electrical arc. The intense heat of the plasma melts the feed material and the swirling gas propels the melt against the inner wall of ore anode 70 creating a falling film. Theoretically the film initially comprises the melted reactants. As it descends through the anode section, the film will comprise reactants and product and will be substantially all product as it falls into crucible 56 forming bath 118. Once the film coats the anode wall and the electrical arc attaches to it via the film, the plasma reactor is then, by definition, a transferred plasma arc reactor.

The following examples portray the efforts to produce molybdenum by decomposing molybdenum disulfide and the reaction conditions resulting in anode erosion as well as those reaction conditions which successfully afforded metallic molybdenum without destroying the anode throat. The molybdenum disulfide concentrate used in each example was purchased from McGee Chemicals Co., Inc. as technical grade powder, 74% minus 400 mesh having the following chemical analysis (weight percent):

Molybdenum: 61.0
Sulfur: 39.7
Copper: 0.017
Zinc: 0.01
Iron: 0.16
Silicon dioxide: 0.21

The fine carbon used in Example Three was #5 PPP Bognar carbon (coke breeze) ground in a Pallman pulverizer with approximately 98% minus 70 mesh and 50% minus 500 mesh as determined by wet screen analysis. The reactor was the anode plasma arc reactor shown in FIG. 2.

EXAMPLE ONE

The reactor and crucible were conditioned by preheating for 60 minutes at 415 amp (89.2 kW) with the stabilizing gas comprising a mixture of hydrogen (1025 SCFH) and argon (72 SCFH), and then for 15 minutes at 450 amp (92.3 kW) with a mixture of hydrogen (450 SCFH) and argon (440 SCFH). After preheating, the stabilizing gas was 100% argon (425 SCFH) and the gross power during concentrate feed was 48.7 kW (about 59 volts at 825 amp). Molybdenum disulfide concentrate was pneumatically fed through two separate lines for 42 minutes at the rate of 65 lb/hr with argon (154 SCFH) as the conveying gas. No pours were made from the crucible.

Found in the crucible were 19.9 lbs of a metallic-like material analyzing for molybdenum 72.1% and sulfur 26.5% by weight and 5.1 lb of powder analyzing for molybdenum 64.3% and sulfur 35.5% by weight. There was no evidence that metallic molybdenum was produced. Yellow needle-like material that had condensed on the lid surface behind the fire clay seal analyzed as 77.8% sulfur. The most striking result was the erosion of the anode. The anode throat, being that portion of the inner anode wall defining throat cavity 72 in FIG. 2, was severely gouged at the top and bottom.

EXAMPLE TWO

The apparatus was preheated for 63 minutes at 420 amp (84.0 kW) with a mixture of hydrogen (1025 SCFH) and argon (72 SCFH) followed by 15 minutes at 380 amp (83.6 kW) with a mixture of hydrogen (450 SCFH) and argon (440 SCFH). The molybdenum disulfide concentrate was pneumatically charged by argon (150 SCFH) at 64.3 lb/hr for 51 minutes. Gross power during the concentrate feed averaged 119.1 kW. The power was 150.0 kW during the first 10 minutes but the voltage dropped to 120 volts with a power of 96.0 kW as the run progressed. The stabilizing gas consisted of a mixture of hydrogen (400 SCFH avg.) and argon (450 SCFH avg.). Initially the flow rates of the hydrogen and argon were less, 385 SCFH and 400 SCFH respectively. However, as the voltage and back pressure dropped, the hydrogen and argon flow rates were increased to 405 SCFH and 485 SCFH respectively. After termination of the concentrate feeding, the apparatus was further heated 4 minutes at 800 amp (96.0 kW) with a mixture of hydrogen (405 SCFH) and argon (485 SCFH) followed by a first pour of the crucible. Further heating for 10 minutes at the same power level and stabilizing gas flow rates preceded a second pour. Remaining in the crucible after the two pours were both metallic and non-metallic materials.

The chemical analyses

| Sample | Weight (lb) | Mo (wt %) | S (wt %) | Mg (wt %) |
|---|---|---|---|---|
| Pour 1 | 12.0 | 80.5 | 16.9 | 0.09 |
| Pour 2 | 0.9 | 79.5 | 18.8 | 0.13 |
| Metallic-like (crucible) | 21.8 | 91.6 | 8.3 | 0.45 |
| Non-metallic (crucible) | 7.0 | 1.3 | 4.9 | 40.3 |

The progressive drops in the voltage and back pressure during the run suggested that anode throat erosion was again occurring. An examination of the short anode, which was used for the first time in this experiment, revealed the throat section to be completely destroyed. Although this experimental procedure afforded metallic-like material analyzing for molybdenum of greater than 90%, it is nevertheless rendered impractical by the extensive anode erosion.

EXAMPLE THREE

The apparatus was preheated for 60 minutes at 425 amp (76.5 kW) with a mixture of hydrogen (1025 SCFH) and argon (72 SCFH) followed by 30 minutes at 450 amp (94.5 kW) with a mixture of hydrogen (450 SCFH) and argon (435 SCFH). The feed consisted of a mixture of molybdenum disulfide concentrate (90%) and fine coke (10%) and was conveyed by argon (150 SCFH) for 51 minutes at 78.7 lo/hr. During the feed the gross power averaged 138.6 kW and the stabilized gas consisted of a mixture of hydrogen (430 SCFH) and argon (410 SCFH). After 33 minutes of feeding, the process was interrupted for 2 minutes to make a first pour followed by resumption of feeding for an additional 18 minutes. Heating of the apparatus continued for 7 minutes at 680 amp (142.8 kW) with a mixture of hydrogen (445 SCFH) and argon (435 SCFH). A second pour was made leaving materials in the crucible about 80% of which appeared to be metallic and the remainder non-metallic. These were analyzed separately. Material was also recovered from the anode and lid flange.

The chemical analyses

| Sample | Weight (lb) | Mo (wt %) | S (wt %) | C (wt %) | Mg (wt %) |
|---|---|---|---|---|---|
| Pour 1 | 5.7 | 8.2 | 26.0 | 6.4 | 38.4 |
| Pour 2 | 2.1 | 7.7 | 24.5 | 6.0 | 37.8 |
| Crucible material | 31.0 | | | | |
| metallic | | 96.9 | 0.7 | 2.7 | 0.4 |
| non-metallic | | 1.4 | 6.8 | 1.7 | 51.1 |
| Anode and lid flange | 0.3 | 81.8 | 5.3 | 5.5 | 5.1 |

A relatively pure sample of metallic molybdenum was prepared by this procedure. Furthermore, there was no erosion of the anode throat during this run. However, there was considerable gouging at the anode exit which is a typical occurrence when using an anode having a sharp-edged outlet wall. The wall is bevelled after several hours of operation. Constructing the anode with a bevelled outlet wall may alleviate the gouging.

In the above examples there was no charge in the crucible at the commencement of the process. It would be possible to charge the crucible with iron melt to yield a master ferromolybdenum alloy as the newly produced molybdenum falls into the crucible mixing with the iron. If too much sulfur is absorbed, desulfurizing can be accomplished using known techniques. In a further embodiment, by installing an induction furnace it would be possible to make a molybdenum product that could be desulfurized and poured.

We claim:

1. A process for controlling the electrical arc in a plasma arc reactor having a first and a second electrode in which a reaction layer covers the first electrode and is a point of arc attachment, which reaction layer is characterized as non-conductive in that the reaction layer at some point during the reaction causes an electrical arc struck between the reaction layer-covered first electrode and the uncovered second electrode to short circuit, which process comprises adding to the reaction layer a material that is more electrically conductive than the reaction layer whereby the arc is stabilized between the uncovered second electrode and the reaction layer-covered first electrode.

2. A process of claim 1 in which the more electrically conductive material is added to the reaction layer as part of a charge of reactant material.

3. The process of claim 1 in which the plasma arc reactor is a falling film plasma arc reactor.

4. A process for decomposing a metallic compound to recover the metal using a plasma arc reactor having two electrodes in which a feed of the metallic compound forms a falling-film on a wall of an electrode which falling film is characterized as non-conductive in that at some point during its descent the falling film causes an electrical arc struck between one electrode and the falling-film on the other electrode to short-circuit, which process comprises adding to the falling film a material that is more electrically conductive than the falling film whereby the falling film is rendered conductive and the arc is stabilized.

5. The process of claim 4 in which the metallic compound is characterized as non-conductive.

6. The process of claim 4 or 5 in which the more electrically conductive material is added to the falling film as part of the feed of metallic compound.

7. The process of claim 5 in which the metallic compound is molybdenum disulfide and the metal recovered is molybdenum.

8. The process of claim 7 in which the more electrically conductive material is fine carbon.

9. A process for decomposing a metallic compound to produce the metal in a falling film plasma arc reactor, while metallic compound is characterized as non-conductive in that a falling film comprising the metallic compound causes an electrical arc struck between an uncovered electrode and a falling film-covered electrode to short circuit, comprising (a) supplying a swirling vortical stabilizing gas stream adjacent the cathode of a plasma arc reactor comprising a cathode and an anode, (b) introducing solid particles of the non-conductive metallic compound into the plasma arc reactor between the ends of an electrical arc, (c) establishing the arc between the cathode and anode to melt the solid particles of the non-conductive metallic compound into a film of material on the wall of the anode, (d) decomposing the non-conductive metallic compound and stabilizing the electrical arc by adding a material that is more electrically conductive than the falling film to the film on the wall of the anode; and, (e) collecting the metal exiting the plasma reactor.

10. A process for controlling an electrical arc in a plasma arc reactor comprising (a) supplying a swirling vortical stabilizing gas stream adjacent the cathode of the plasma arc reactor comprising a cathode and an anode, (b) introducing solid particles of reactant material into the plasma arc reactor between the ends of an electrical arc, (c) establishing the arc between the cathode and anode to melt the reactant material forming a film on the wall of the anode, the film being characterized as non-conductive at some point during its descent in that the film causes an electrical arc struck between the cathode and film-covered anode to short circuit; and (d) adding a material that is more electrically conductive than the film comprising melted reactant material to the film on the wall of the anode whereby the electrical arc is stabilized.

11. The process of claim 9 or 10 in which the more electrically conductive material is added with the solid particles in step (b).

12. A process for reacting molybdenum disulfide to produce substantially pure molybdenum comprising (a) supplying a swirling vortical stabilizing gas stream adjacent the cathode of a plasma arc reactor comprising a cathode and an anode, (b) introducing solid particles of molybdenum disulfide into the plasma reactor between the ends of an electrical arc, (c) establishing the arc between the cathode and anode to melt the solid particles of molybdenum disulfide into a film of material on the wall of the anode, (d) reacting the molybdenum disulfide by adding a material that is more electrically conductive than the film comprising molybdenum disulfide to the film on the wall of the anode and producing substantially pure molybdenum; and, (e) collecting the substantially pure molybdenum exiting the plasma reactor.

13. The process of claim 12 in which the more electrically conductive material is added to the falling film by introducing the more electrically conductive material into the plasma reactor with the solid particles of molybdenum disulfide.

14. The process of claim 13 in which the more electrically conductive material is fine carbon.

* * * * *

UNITED STATES PATENT AND TRADEMARK OFFICE

CERTIFICATE OF CORRECTION

PATENT NO. : 4,234,334

DATED : November 18, 1980

INVENTOR(S) : Donald R. MacRae et al.

It is certified that error appears in the above—identified patent and that said Letters Patent is hereby corrected as shown below:

Column 8, Claim 9, line 33, "while" should read -- which --.

Signed and Sealed this

*Seventeenth* Day of *March 1981*

[SEAL]

*Attest:*

RENE D. TEGTMEYER

*Attesting Officer*

*Acting Commissioner of Patents and Trademarks*